US005749978A

United States Patent [19]

Colombani et al.

[11] Patent Number: 5,749,978

[45] Date of Patent: May 12, 1998

[54] METHOD AND DEVICE FOR THE CONTROLLED FORMING AND FEEDING OF A GASEOUS ATMOSPHERE HAVING AT LEAST TWO COMPONENTS, AND APPLICATION IN PLANTS OF THERMAL OR CARBURIZING TREATMENT

[75] Inventors: Piero Colombani, Milan; Alessandro Stucchi, Buccinasco, both of Italy

[73] Assignee: Lentek S.r.l., Corsico, Italy

[21] Appl. No.: 619,464

[22] PCT Filed: Sep. 2, 1994

[86] PCT No.: PCT/EP94/02918

§ 371 Date: Mar. 25, 1996

§ 102(e) Date: Mar. 25, 1996

[87] PCT Pub. No.: WO95/08387

PCT Pub. Date: Mar. 30, 1995

[30] Foreign Application Priority Data

Sep. 24, 1993 [IT] Italy ..... MI93A2040

[51] Int. Cl.[6] ..... C23C 8/20; C23C 8/40; B01F 3/02

[52] U.S. Cl. ..... 148/216; 266/252; 266/254; 266/257; 261/64.1

[58] Field of Search ..... 148/216; 266/252, 266/254, 257; 261/64.1, 121.1, 139, 124, 129, 153

[56] References Cited

U.S. PATENT DOCUMENTS

| | | | |
|---|---|---|---|
| 4,445,945 | 5/1984 | Schwalm | 148/216 |
| 4,472,209 | 9/1984 | Langerich et al. | 148/216 |
| 4,519,853 | 5/1985 | Kostelitz et al. | 148/216 |
| 4,904,419 | 2/1990 | Reynolds | 261/64.1 |
| 5,078,922 | 1/1992 | Collins et al. | 261/139 |

FOREIGN PATENT DOCUMENTS

| | | |
|---|---|---|
| 0 160 314 | 11/1985 | European Pat. Off. . |
| 0 524 432 | 1/1993 | European Pat. Off. . |
| 1 416 542 | 9/1965 | France . |
| 2 227 896 | 11/1974 | France . |
| 2558737 | 8/1985 | France . |
| 2 564 566 | 11/1985 | France . |

*Primary Examiner*—Deborah Yee

*Attorney, Agent, or Firm*—Millen, White, Zelano, & Branigan, P.C.

[57] ABSTRACT

A method for the forming and feeding of a gaseous atmosphere having two components, at least one of which under the form of vapour obtained from liquid, envisages to bubble a first gaseous component within a liquid component kept under controlled conditions of pressure and temperature and then to remove the gas-vapour mixture having controlled composition. In order to realise the method according to the invention, a device is foreseen that comprises a saturator reservoir containing the liquid component, means to keep the level of the liquid in the reservoir substantially constant, means to bubble a flow of gaseous component within the saturator, as well as means to control pressure and temperature inside the saturator itself. The invention can be applied in particular to the forming of carburizing atmospheres and of atmospheres used in thermal treatments of steel materials, specially gas carburizing treatments.

31 Claims, 4 Drawing Sheets

METHOD AND DEVICE FOR THE CONTROLLED FORMING AND FEEDING OF A GASEOUS ATMOSPHERE HAVING AT LEAST TWO COMPONENTS, AND APPLICATION IN PLANTS OF THERMAL OR CARBURIZING TREATMENT

TECHNICAL FIELD

The present invention concerns a method and a device for the controlled formation and feeding of a gaseous atmosphere having at least two components, one of which under the form of vapour coming from a liquid. The invention also concerns the application of the aforementioned method and device particularly in plants of thermal treatment or in plants for carburizing processes.

BACKGROUND ART

A particularly interesting application, that will be described more in detail and claimed—without being considered for that as a limitation to the protective scope of the invention—is that of the thermal treatment in ovens and in particular of the gas carburizing treatment of steel products, namely a treatment that allows the absorption of carbon atoms in the superficial layers of the product in order to increase its superficial hardness and to improve its fatigue strength.

The formation and feeding of a gaseous atmosphere having two components, one of which under the form of vapour, have always represented and still now represent a serious problem in all cases in which it is necessary or advisable to maintain and/or to control the ratio between components. Not limiting examples of atmospheres of this kind are given by some types of comburent atmospheres and more specifically those in which the fuel is under liquid form, such as atmospheres suitable to feed burners with methanol or other liquid fuels, as well as comburent atmospheres for feeding motors. Other cases of application are those related with the creation and feeding of atmospheres for thermal treatments of steels in gaseous atmosphere, such as brazing, nitriding, annealing and carburizing treatments,. when one of the components of the atmosphere is obtained from a substance under liquid form.

As far as carburizing treatments are concerned, that at present represent those for which the application of the present invention has mainly been studied, they are generally carried out in heating ovens, where a gas mixture including a carburizing agent is present. Taking into consideration that the process takes place at temperatures exceeding 800 degrees C., the carburizing agent present in the oven dissociates, thus freeing carbon atoms that are absorbed by the superficial layers of the steel up to depths of a few millimeters.

At the present time the carburizing process of mechanical components, such as for instance gears for the motor industry, is performed in periodic kilns of large size or in continuous sections that use a gas atmosphere created therein or produced out of the oven by endothermic generators.

The currently used enrichment fluids to supply carbon required by the process are gaseous hydrocarbons such as methane or propane, and the monitoring of the carburizing process is performed by means of oxygen probes associated with computerised systems. The actual trend of the technology is to obtain "in situ" a protective atmosphere, for example by means of nitrogen and methanol directly introduced into the oven. In the hot chamber of the oven, necessarily kept at suitable temperature, methanol dissociates in CO and $H_2$ with endothermic reaction in a way to create the "carrying" protective atmosphere that constitutes the necessary support for the carburizing process.

There are cases in which the poor local availability, if not the absence, of reliable hydrocarbons, such as methane or propane, necessarily involves the use of different carburizing agents that, though being economical and easy to be found, do not allow the direct application of the known technologies for carburizing processes. For example, according to a method known at the present time, the gas carburizing treatment is performed by producing "in situ" a carrying atmosphere with the help of nitrogen and methanol and a carburizing atmosphere by dripping organic liquids such as methyl alcohol ($CH_3OH$) and ethylacetate ($CH_3$—COO—$C_2H_5$).

The control of the process is carried out manually by regulating the number of drops of liquid on the basis of the operator's experience and of data supplied by steel samples that are checked during the most significant stages of the process.

One of the major drawbacks of this method lies in the difficulty of finding reliable control units that can be able to regulate in a proportional way very small amounts of liquids which, for their nature, are energetic solvents. Moreover a definitely serious problem is the application of reliable automatic controls, such as for instance those comprising an oxygen probe and a computerised system, since the oxygen probe has extremely fast response times and results to be hardly suitable for being applied to a drip-feed intermittent enrichment system.

DISCLOSURE OF THE INVENTION

The above having been stated, an object of the present invention is that of providing a method and a device for the forming and feeding of a gaseous atmosphere having two components, at least one of which under the form of vapour obtained from a liquid, wherein the ratio between the components is strictly controllable with high precision.

Another object of the present invention is that of providing a method and a plant for the creation and feeding of comburent gaseous atmospheres or gaseous atmospheres for steel thermal treatments, wherein atmospheres or parts thereof have the aforementioned origin and characteristics.

A more specific object of the invention is that of providing a method and a plant for carburizing processes, that allows to generate "in situ" a carburizing and/or carrying gaseous atmosphere by using liquid organic compounds.

A further object of the present invention is that of providing a method and a plant for gas carburizing processes, that allows a reliable control of the composition of the treatment atmosphere by using liquid organic compounds.

These objects are achieved by means of the present invention, that generally concerns a method for the forming and feeding of a gaseous atmosphere having two components, at least one of which under the form of vapour obtained from liquid, characterized in that a first gaseous component is bubbled within the liquid component under controlled conditions of pressure and temperature, and in that the gas-vapour mixture having controlled composition can be removed.

Furthermore, the invention concerns a device for the application of the aforesaid method, characterized in that it comprises a saturator containing the liquid component, means to maintain the liquid level in the container substantially constant, means to cause to bubble a flow of gaseous component inside the saturator, as well as means to control pressure and temperature inside the saturator itself.

Preferably, pressure is kept constant, for example equivalent to the atmospheric value, and the saturator temperature is adjusted in order to obtain a corresponding and precise regulation of the ratio between the two components.

It must be noticed that the saturator is an equipment already known per se, but the use of which has never been proposed so far for the creation of a gaseous atmosphere having a component derived from a liquid, in which a tight and extremely precise control is performed on the ratio between the components of the atmosphere itself, with the possibility of easily and quickly modifying said ratio. As said above, the invention finds particularly interesting applications in the formation of comburent atmospheres, constituted as already seen, or in the formation of atmospheres for thermal treatments such as brazing, nitriding, annealing and specially gas carburizing.

In the latter case, the thermal treatment is carried out in oven, in presence of a carrying atmosphere having reducing effect and of a carburizing atmosphere able of releasing carbon atoms in a way to allow their absorption in the superficial layers of said products. According to the invention, at least one atmosphere, either the carrying or the carburizing atmosphere, is generated in situ by feeding said oven with a gaseous mixture obtained by causing a carrier gas to bubble in a liquid organic compound in order to allow the transfer of said organic compound to the oven under the form of vapour.

The vaporisation of the liquid organic compound allows to perform the control of the treatment atmosphere in a precise and reliable way by means of the currently most common computerised control systems, thus ensuring a product of high quality and a considerable level of reproducibility of results.

According to an advantageous feature of the invention, the carburizing atmosphere is obtained by saturating the carrier gas with vapours of organic liquid, and moreover at least part of the carrying atmosphere is generated in situ by feeding the oven with a gaseous mixture obtained by causing a carrier gas (equal or different from the previous one)to bubble within a second liquid organic compound in order to allow its passage to the oven under the form of vapour.

In this manner it is possible to perform the carburizing process even in absence of the currently used gaseous organic compounds, allowing appreciable advantages both from the logistic and the economic point of view.

The invention furtherly concerns a plant for the gas carburizing treatment of steel products, of the type comprising an oven for the thermal treatment of said products in presence of a carrying atmosphere with reducing effect and of a carburizing atmosphere capable of releasing carbon atoms in a way to allow their absorption in the superficial layers of said products, characterized in that it comprises at least a saturator containing a liquid organic compound, said saturator device comprising means to regulate the temperature of said liquid organic compound, as well as means to cause a flow of a carrier gas to bubble within said liquid organic compound and therefore allowing the transfer of said organic compound under the form of vapour.

BEST MODE FOR CARRYING OUT THE INVENTION

Further characteristics and advantages of the present invention will become more evident from the following description, given by way of illustration and with no limiting purposes, with reference to the accompanying drawings, where:

Figure 1:
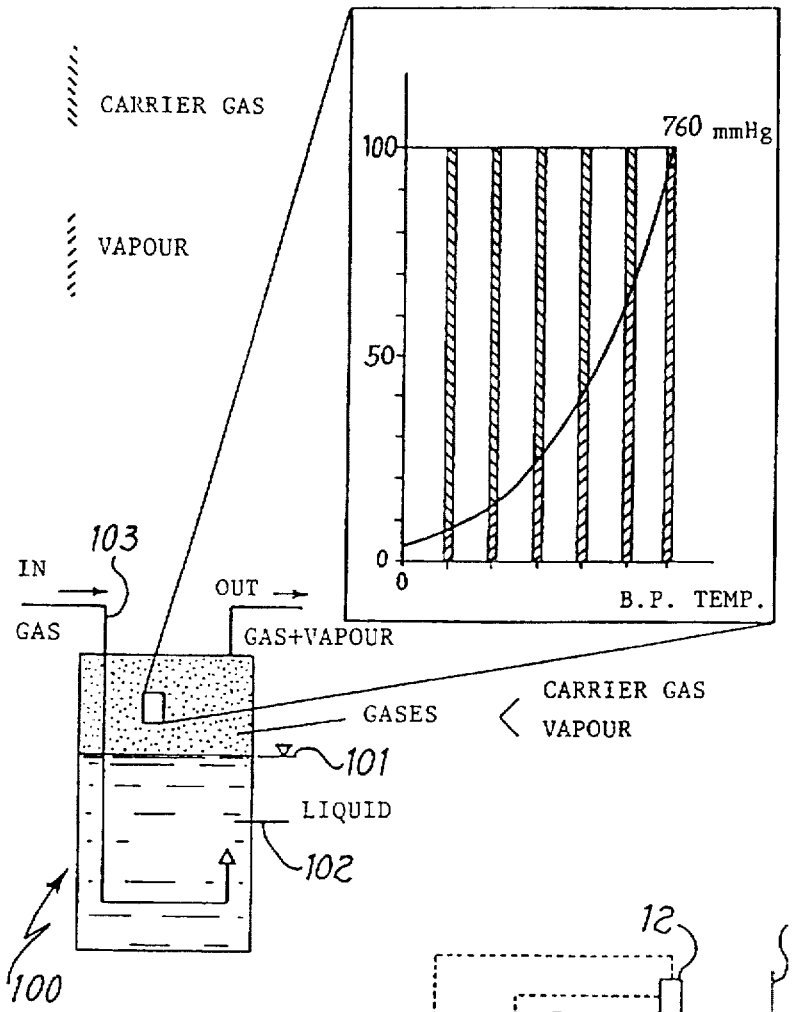
FIG. 1 is a scheme illustrating the structure and the operation of a saturator working according to the present invention, the figure comprising a diagram illustrating the tension variation of the liquid vapour and then the relevant percentages of the components according to the temperature changes taking place in the saturator.

FIG. 1 schematically shows a saturator device 100, essentially constituted by a closed reservoir in which there is a liquid—preferably but not necessarily an organic liquid—kept at a preset level 101 thanks to controlled feeding in 102. Within the liquid a carrier gas is caused to bubble—constituting the second component of the gaseous atmosphere to be obtained—which is fed for example through the duct 103. Over the liquid level 101 therefore, a mixture composed by the gas fed in 103 and the vapours of the liquid fed in 102 is caused to form in the saturator, in said mixture the percentage ratios between the two components being strictly dependent on pressure and temperature. In the specific case shown—and in general in the practical application of the invention—it is preferable to maintain the pressure at a constant value, for instance equivalent to the atmospheric value, and to control said percentage ratios by means of temperature control. The diagram illustrated in the FIG. 1 itself is thus obtained, at atmospheric pressure, where in abscissae are plotted the temperatures up to the boiling point of the liquid and in ordinates the percentages of the components, as indicated.

The saturator thus obtained and controlled allows to form and feed comburent atmospheres for burners, for motors or other, in which the gaseous component is generally air, whereas the liquid vaporised component is generally a light organic compound.

Still by applying the same principles, it is possible to obtain and feed gaseous atmospheres for thermal treatment in oven of metal materials, such as brazing, nitriding, annealing and other treatments of steel products.

Figure 2:
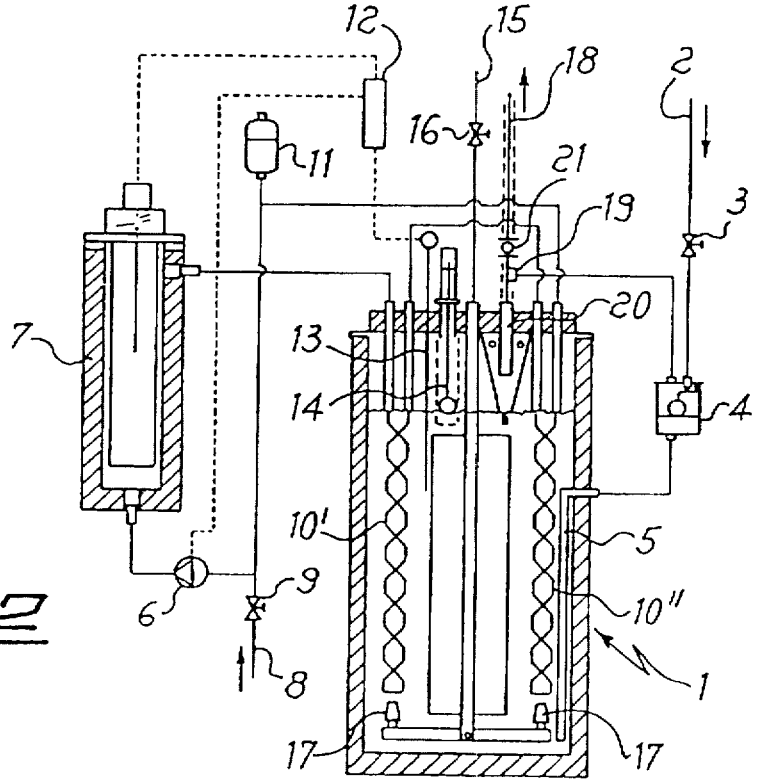
FIG. 2 is a schematic view of a saturator device used in a plant according to the invention for gas carburizing treatments.

An application particularly studied by the Applicant and presented herein refers to treatments of gas carburizing, that take advantage, as illustrated in FIG. 2, of a saturator device 1 constituted by an insulated container where an organic liquid is introduced, kept at a substantially constant level and at controlled temperature. The liquid organic compound is fed, through a duct 2 provided with an on-off valve 3, to a small reservoir 4. The latter is provided with an on-off float valve in order to keep the liquid level constant in the tank itself and in the saturator device 1 connected thereto through a duct 5. In fact, it is particularly important to maintain the level of the liquid organic compound constant in order to maintain in the upper portion of the saturator device 1 a substantially constant free volume for vapours generated. A float indicator 14 assures the continuous control of the liquid level present in the saturator device 1.

In order to allow the change of state and the transfer of the liquid organic compound under the form of vapour, the saturator device 1 comprises means to regulate the temperature of the organic compound and means to bubble therein a flow of carrier gas at a controlled rate.

In the preferential embodiment of the invention, the means to regulate the temperature of the liquid organic compound present in the saturator device 1 are constituted by a hydraulic circuit comprising a pump 6 for the circulation of a fluid of thermal exchange, such as for instance water, and means 7 to heat the fluid arranged downstream of the pump 6. The foreseen variations in volume of the heated fluid are absorbed by means of an expansion tank 11 located upstream of the-pump 6. Between the expansion tank 11 and the pump 6 there is provided the feeding connection of the fluid coming from a duct 8 on which an on off valve 9 is provided. Inside the saturator device 1 there is provided a heat exchanger that, in the embodiment shown in FIG. 2, is constituted by two elements 10' and 10" serially connected downstream of the heating means 7 and upstream of the expansion tank 11. The elements 10' and 10" are plunged in the organic liquid compound in order to allow the heat exchange between the fluid of thermal exchange of the circuit and the organic compound contained in the saturator device 1.

The temperature control of the organic liquid compound is performed by means of a pyrometer 12 that acts on the recirculation pump 6 and on the heating means 7 as a function of the temperature values detected by a thermoresistor 13.

Carrier gas is fed through a duct 15, provided with an on-off valve 16, as far as a group of injectors 17 plunged in the organic liquid in the lower section of the saturator device 1.

From the injectors 17 a finely dispersed flow of the abovesaid carrier gas is then bubbled that, passing through the organic liquid in its upward movement, saturates with vapours as a function of the temperature of the liquid itself.

As it is well known, the vapour tension of a liquid varies as a function of temperature and pressure.. Assuming to work at a preset operating pressure, it is therefore possible to plot for any liquid the specific curve of vapour tension as a function of temperature, of the type of the one reported in FIG. 1.

In this way it is possible to regulate in a precise way the composition of vapours, and consequently the relevant quantity of organic compound coming out of the saturator device 1, by acting on the temperature of the liquid organic compound.

Again with reference to FIG. 2, vapours generated come out through an insulated and heated duct 18 communicating with an outlet collector 20 provided in the upper portion of the saturator device 1. A single-acting valve 21, positioned downstream of the offtake 19, prevents vapours from flowing back towards the saturator device 1. The carburizing treatment envisages the treatment in oven of steel products in presence of a gaseous mixture consisting of a carrying atmosphere having reducing effect and a carburizing atmosphere releasing carbon atoms.

A way of realization of the method according to the present invention involves the generation "in situ" of the carburizing atmosphere by feeding the oven with a gaseous mixture obtained by causing a carrier gas to bubble within a first organic liquid in order to allow its transfer under the form of vapour.

For this purpose a flow of nitrogen at low pressure and at ambient temperature is used as carrier gas that is caused to bubble within a first saturator device containing ethylacetate. The generation of a carrying atmosphere can be realized "in situ" according to known methods, for example by using the direct injection of nitrogen and methanol.

In the hot chamber of the oven, for temperatures exceeding 800 degrees C., methanol ($CH_3OH$) dissociates according to the reaction $$CH_3OH \rightarrow CO+2H_2$$

thus generating one volume of carbon oxide and two volumes of hydrogen for each volume of methanol. The gaseous mixture thus obtained constitutes part of the carrying atmosphere. This is also defined as "protective" atmosphere because of its reducing effect that allows to avoid the undesirable formation of oxides on the treated products.

The carburizing atmosphere is obtained from ethylacetate ($CH_3—COO—C_2H_5$) that on the contrary dissociates according to the reaction $$CH_3COOC_2H_5 \rightarrow 2CO+4H_2+2C$$

thus freeing two carbon atoms for each volume of ethylacetate that are available for being absorbed in the superficial layers of steel products. It is interesting to note that the dissociation of ethylacetate leaves the proportions between carbon oxide and hydrogen unchanged, therefore maintaining the reducing effect of the carrying atmosphere.

According to an advantageous feature of the present invention also (or possibly only) the carrying atmosphere is generated "in situ" by feeding the oven with a gaseous mixture obtained by bubbling a nitrogen flow in methanol for obtaining its transfer under the form of vapour.

This allows to avoid the use of a direct injection system in the oven for nitrogen and methanol, which involves the need of having said compounds available at high pressure.

Figure 3:
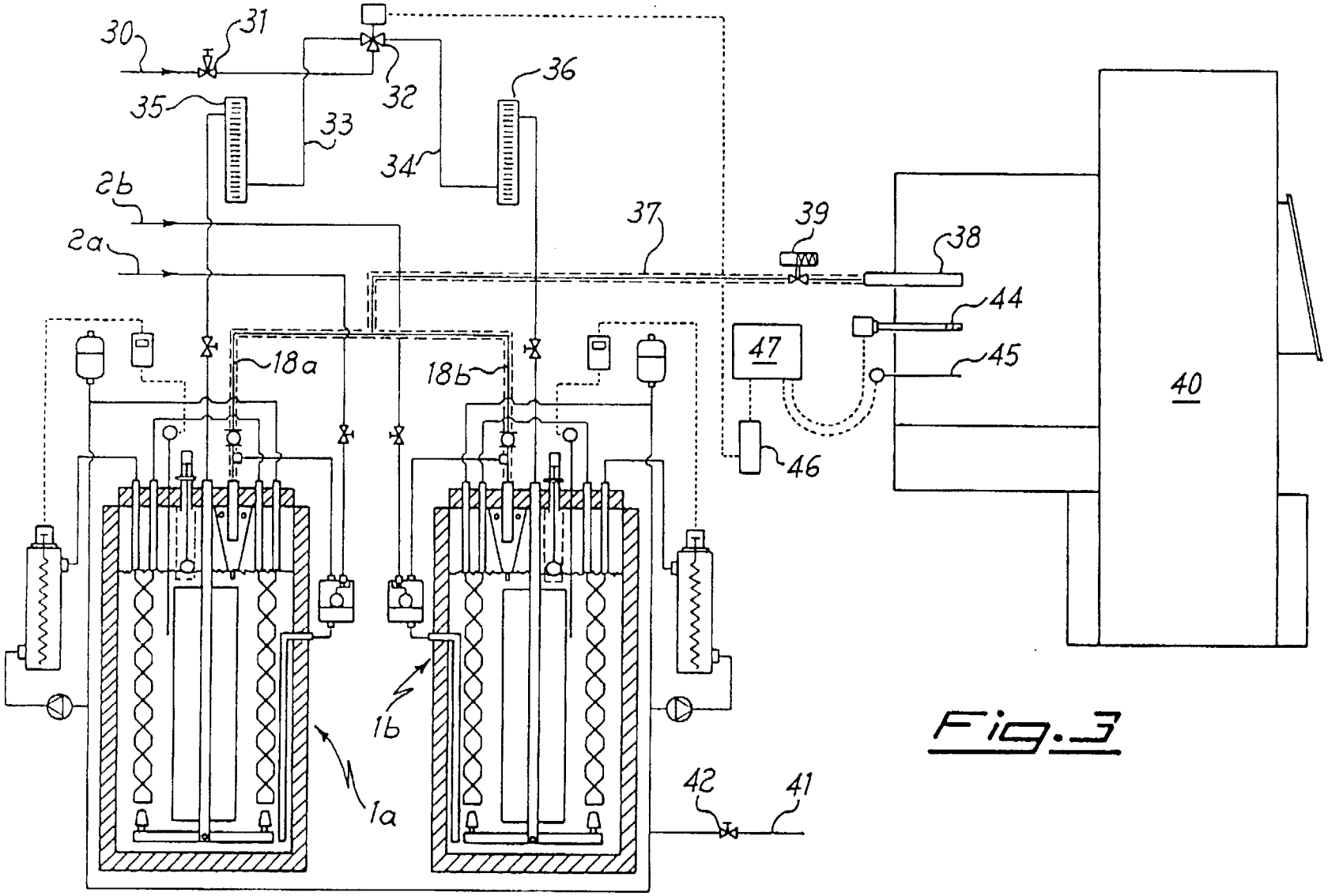
FIG. 3 is a schematic view of a plant for gas carburizing processes according to an embodiment of the invention.

FIG. 3 represents a plant for the realisation of the method according to the invention. There are in fact provided two saturator devices **1*a* and 1*b*, respectively containing methanol, fed through a duct 2*a*, and ethylacetate, fed through a duct 2*b***.

According to an advantageous feature of the invention, the saturator devices **1*a* and 1*b*** are provided with means for the independent regulation of the temperature of each organic liquid.

The means for independently regulating the temperature of the saturators are constituted by two independent hydraulic circuits fed with water through a common duct 41, along which there is positioned an on/off valve 42.

By having two independent saturator devices available, devoted to methanol and ethylacetate respectively, it is possible to set the operating temperature of each one of them in order to obtain in the oven an atmosphere of steady composition.

Nitrogen necessary for the plant operation is supplied through a feeding duct 30 provided with an on/off valve 31. Downstream of the on/off valve 31, there is a three-way motorised valve 32, of the proportional type, that allows to convey the nitrogen flow to the saturator device **1*a* through the duct 33, or to the saturator device 1*b* through the duct 34, or to both of them. Along ducts 33 and 34, upstream of the saturator devices 1*a* and 1*b*, there are provided flowmeters 35 and 36** respectively, which allow the detection of the flow rate of each nitrogen flow.

The outlet ducts **18*a* and 18*b* of each saturator device are both of the heated and insulated type. These flow into a single duct 37, of the heated and insulated type as well, which conveys the gaseous mixture to a header 38 entering the oven 40. Upstream of the header 38 there is an on/off valve 39**.

The monitoring of the different conditions of the process progress is carried out by means of an oxygen probe 44, that allows to detect the composition of the atmosphere inside the oven, and of a thermocouple 45 to detect the temperature inside the oven.

The signals coming from the oxygen probe 44 and the thermocouple 45 are sent to a control module 46 through an interface 47 to determine the composition of the internal atmosphere and, in particular, the carbon potential inside the oven 40.

The regulation of the atmosphere inside the oven 40 is performed by the control unit 46 acting on the three-way motorised valve 32. The latter is of the proportional type and allows to increase the nitrogen flow towards one of the two saturators, for instance saturator 1*a*, simultaneously decreasing the nitrogen flow towards the other saturator device 1*b*, or vice versa.

It is thus possible to vary in an automatic way the composition of the atmosphere inside the oven 40, namely the proportion between the carrying atmosphere and the carburizing atmosphere, having therefore carbon available that is useful for the carburizing process starting from a maximum value, corresponding to a total nitrogen flow rate in the saturator device 1*b*, up to a nil value in the case of total nitrogen flow rate in the saturator device 1*a*.

A further way of realisation of the method according to the present invention involves the generation "in situ" of the carburizing atmosphere by feeding the oven with a gaseous mixture obtained by bubbling a exothermic gas as carrier gas within a first organic liquid in order to allow its transfer under the form of vapour. For this purpose a flow of exothermic gas at low pressure and at ambient temperature is used that is caused to bubble in a saturator device containing ethylacetate or acetone.

In this way it is possible to obtain an atmosphere for the carburizing treatment without using nitrogen that, in some cases, can be locally unavailable.

According to an advantageous feature of the invention, exothermic gas is obtained by bubbling air as carrier gas in methanol to obtain a gaseous mixture that is submitted to combustion and subsequent dehumidification by refrigeration.

Figure 4:
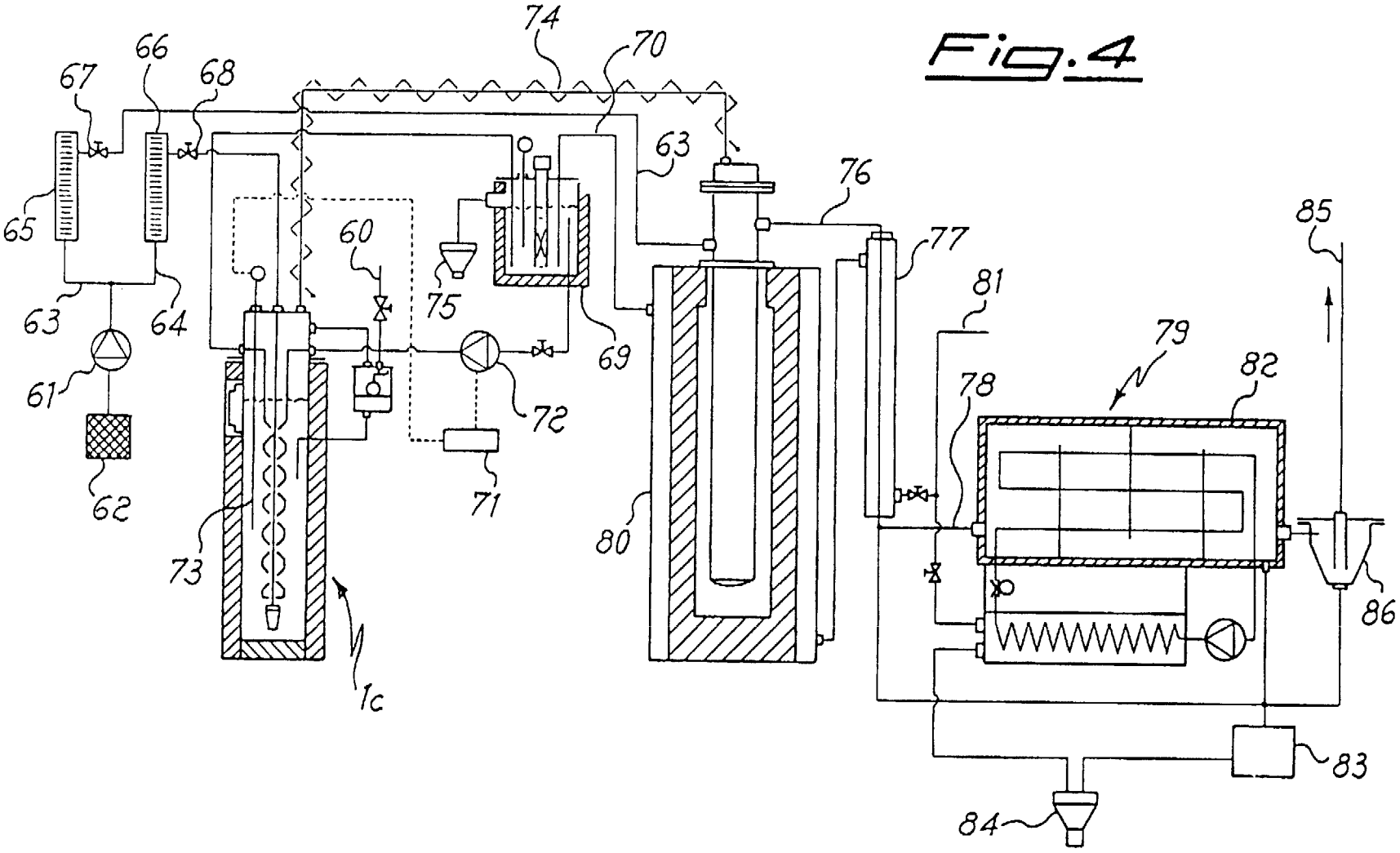
FIG. 4 is a schematic view of a plant for the generation of an exothermic gas which is used in a plant for gas carburizing processes according to a further embodiment of the present invention.

FIG. 4 illustrates an equipment for the generation of exothermic gas, that uses a saturator device 1*c* containing methanol in which air is caused to bubble.

The feeding of methanol to the saturator device 1*c* is carried out through a duct 60, while air is drawn from the atmosphere by means of a compressor 61 provided with filter 62. Downstream of the compressor 61 the air flow is conveyed to two ducts 64 and 63 that feed the saturator device 1*c* and a sealed spill burner 80 respectively. Along the ducts 63 and 64 there are provided relevant flowmeters 65 and 66, as well as relevant on/off valves 67 and 68.

In this case the hydraulic circuit that allows the heating of methanol contained in the saturator device 1*c* comprises a reservoir 69, where flows the heated water coming from the cooling jacket of the burner 80 through a duct 70. The excess water in the reservoir 69 is discharged in 75.

The control of the water temperature is performed by means of a pyrometer 71 acting on a recirculation pump 72 on the basis of the temperature detected by a thermoresistor 73 positionted in the saturator device 1*c*.

Vapours coming out of the saturator device 1*c* feed the burner 80 through a duct 74 of the insulated and heated type. Combustion produces a poor exothermic atmosphere with characteristics of inert gaseous mixture, being mainly constituted by $N_2$, $CO_2$, $H_2O$ and by residual fuels in very low percentages.

The gas mixture coming out of the burner 80 is first of all conveyed through a duct 76 to a first heat exchanger 77 and then, through a duct 78, to a refrigerator 79 that lowers its temperature down to 6–8 degrees C. and reduces its humidity, bringing the amount of $H_2O$ to about 1% in volume. The heat exchanger 77 allows a first drop in temperature and consequently in the water content present in the combustion products coming out of the burner 80.

The refrigerator 79 comprises a cooling and dehumidifying chamber 82 through which the gas mixture is caused to pass in relation of thermal exchange with the evaporator of a refrigerating circuit. The water forming in the chamber 82 is collected in a steam trap 83 and released through an exhaust outlet 84. A common inlet 81 provides the water supply for the hydraulic circuit comprising the heat exchanger 77, the refrigerator 79 and the cooling jacket of the burner 80.

The refrigerated exothermic gas obtained at the outlet of the chamber 82 passes through a separator 86 followed by a duct 85 for the carburizing plant feeding.

An exothermic gas is thus obtained that can be used for the protection of oven chambers or for their purging, as it can also be used for gas carburizing treatments as carrier gas when appropriately enriched with ethylacetate ($CH_3$—$COO$—$C_2H_5$) or acetone ($CH_3$—$CO$—$CH_3$). For the latter use it is necessary to reconvert $CO_2$ and $H_2O$ into CO and $H_2$ respectively, by reacting the refrigerated exothermic gas with about 7–8% of ethylacetate or acetone vapours. In this way an atmosphere would be obtained in the oven consisting of approximately 26–28% CO, 17–20% $H_2$ and $N_2$ for the remaining part.

A thus composed atmosphere, though having its own carbon potential, is not provided with sufficient carburizing properties and, in case of failure to completely reconvert $CO_2$ and $H_2O$, it would have decarburizing characteristics.

It is therefore necessary to convey into the oven a quantity of ethylacetate or acetone vapours exceeding the one strictly necessary for total reconversion of $CO_2$ and $H_2O$, thus making available a carbon amount useful for carburizing.

An atmosphere of this type produced "in situ" allows to be varied, with extreme simplicity and high speed, in response to the quick variations of the carbon potential imposed by the treatment cycle.

A further advantage in the use of a refrigerated exothermic atmosphere is that of making oxidative elements available, such as $CO_2$ and $H_2O$, which allow to easily clean the oven from possible deposits of soot and pre-oxidation of the material under treatment.

Figure 5:
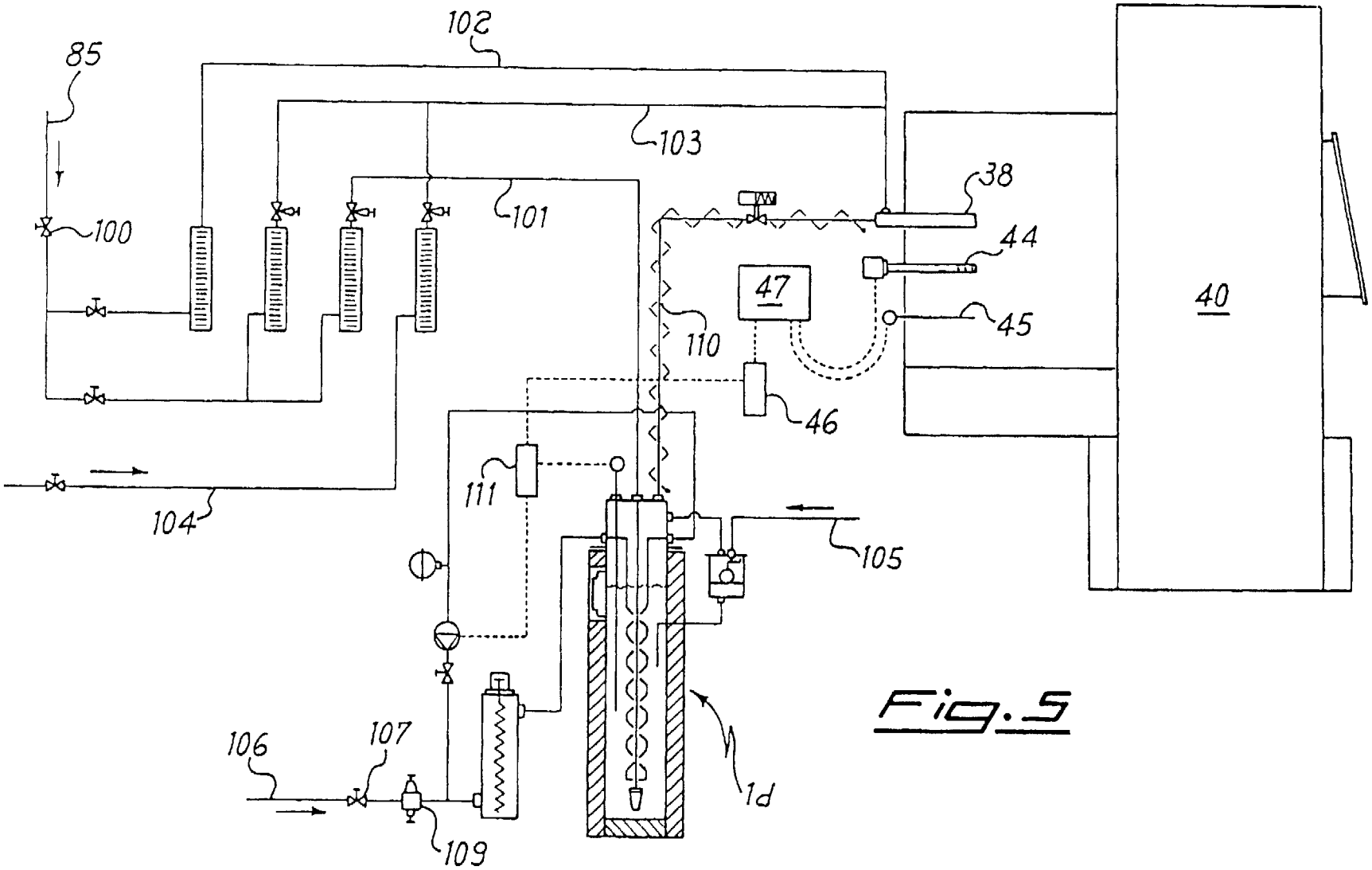
FIG. 5 is a schematic view of a plant for gas carburizing processes according to a further embodiment of the invention.

FIG. 5 represents a plant for gas carburizing treatment, which receives the refrigerated exothermic gas, produced by an equipment such as the one illustrated in FIG. 4, through a duct 85 provided with an on/off valve 100. Downstream of the latter the gas flow is split in different ducts to allow gas feeding to a saturator device 1*d* through a duct 101, or the direct connection with the oven 40 through a duct 102. A further duct 103 allows to convey exothermic gas towards the oven 40 after its mixture with a gaseous additive fed through a duct 104.

The saturator device 1*d* is fed with ethylacetate or with acetone through a feeding duct 105.

As already previously illustrated, the means to regulate the temperature of the saturator device are constituted by a hydraulic circuit fed with water through a duct 106 along which there are positioned an on/off valve 107 and a pressure reducer 109.

In the saturator device 1*d* exothermic gas is enriched with ethylacetate or acetone vapours and conveyed towards the feeding header 38 in the oven 40 through a duct 110 of heated and insulated type.

The monitoring of the conditions of the process progress is again performed by means of an oxygen probe 44, which allows to detect the composition of the atmosphere inside the oven, and of a thermocouple 45 to detect the temperature inside the oven 40.

In this case the regulation of the atmosphere inside the oven 40 is performed by the control unit 46 acting indirectly on the temperature of the organic liquid in the saturator device 1*d* through the pyrometer 111.

This allows to vary in a very simple and rapid way the carbon potential in the treatment atmosphere by only varying the temperature of the organic liquid present in the saturator device 1*d*.

We claim:

1. A plant for the thermal treatment of metal materials inside an oven (40) in the presence of a treating atmosphere and comprising means (44, 45, 46) for continuously detecting the composition of the treating atmosphere within the oven, comprising at least a saturator device (1, 1*a*, 1*b*, 1*c*, 1*d*) containing a liquid compound, said saturator device (1, 1*a*, 1*b*, 1*c* 1*d*) having means (6, 7, 10', 10", 12 13) to regulate the temperature of said liquid compound, as well as means (15, 16, 17) to cause a flow of carrier gas to bubble within said liquid compound and allow the formation and transfer to said oven (40) of a gas vapor mixture having a controlled composition in response to the detected composition of the treating atmosphere, so as to allow a continuous regulation of the composition of the treating atmosphere within said oven.

2. A plant according to claim 1, comprising two different saturator devices (1*a*, 1*b*; 1*c*, 1*d*) containing a first and a second liquid compound respectively, said saturator devices being provided with means (6, 7, 10', 10", 12, 13; 71, 72, 73, 111) to regulate independently the temperature of each of said liquid compounds, as well as means (32; 68, 100) to regulate independently the flow rate of relevant carrier gases.

3. A plant according to claim 1, comprising at least a first saturator device (1*b*; 1*d*) contaning a first liquid organic compound to generate and transfer said gas-vapor mixture to said oven (40) and allow the formation in situ of a carburizing atmosphere within said oven.

4. A plant according to claim 3, further comprising at least a second saturator device (1*a*) containing a second liquid organic compound to generate and transfer said gas-vapor mixture to said oven (40) and allow the formation in situ of a protective atmosphere within said oven.

5. A plant according to claim 3, further comprising at least a second saturator device (1*c*) containing a second liquid organic compound to generate and transfer said gas-vapor mixture to a burner (80) and allow the formation of an exothermic gas within said burner.

6. A plant according to claim 5, further comprising a refrigerator (79) having a cooling and dehumidifying chamber (82) to lower the temperature and reduce the humidity of said exothermic gas.

7. A plant according to claim 1, wherein each of said saturator devices (1, 1*a*, 1*b*, 1*c*, 1*d*) comprises means (2, 3, 4, 5) to keep substantially constant the level of the liquid compound contained in the saturator device.

8. A plant according to claim 1, wherein said means for detecting the composition of the treating atmosphere inside the oven comprises an oxygen probe (44), a thermocouple (45) to detect the treating temperature, and a control unit (46) capable of determining the carbon potential as a function of the signals coming from said prove (44) and said thermocouple (45).

9. A plant according to claim 8, wherein said control unit (46) is capable of controlling means (111) to regulate the temperature of the liquid compound contained in each of said saturator devices (1, 1*a*, 1*b*, 1*c*, 1*d*).

10. A plant according to claim 8, wherein said control unit (46) is capable of controlling means (32) to regulate the flow rate of the carrier gases which are caused to bubble in each of said saturator devices (1, 1*a*, 1*b*, 1*c*, 1*d*).

11. A plant according to claim 10, wherein said means (32) for the regulation of the flow rate of said carrier gases comprises a three-way motored valve of the proportional type capable of conveying the flow of carrier gas to the first, the second or to both said saturator devices (1*a*, 1*b*).

12. A plant according to claim 1, wherein said means for the regulation of the temperatures of the liquid compounds contained in each of the saturator devices (1, 1*a*, 1*b*, 1*c*, 1*d*) are constituted by a hydraulic circuit comprising a pump (6) for the circulation of a fluid of thermal exchange, means (7) to heat said fluid, a heat exchanger (10', 10") arranged in said saturator device (1, 1*a*, 1*b*, 1*c*, 1*d*) and in contact with said liquid compound, as well as at least a pyrometer (12) provided with thermoresistor (13) to allow the control of the temperature of said liquid compound by acting on said circulation pump (6) and/or on said means (7) for heating said fluid.

13. A method for the thermal treatment of metal materials inside an oven (40) in presence of a treating atmosphere, comprising continuously detecting the composition of said treating atmosphere, characterized in that at least part of said treating atmosphere is generated in situ by feeding said oven (40) with a gas-vapor mixture obtained by causing a carrier gas to bubble within a liquid compound and allow the transfer to the oven of a gas-vapor mixture having a controlled composition of said carrier gas and said compound in the form of vapor in response to the detected composition of said treating atmosphere.

14. A method according to claim 13, wherein said treating atmosphere comprises a protective atmosphere having a reducing effect and a carburizing atmosphere capable of releasing carbon atoms to allow their absorption in the superficial layers of said metal materials.

15. A method according to claim 14, wherein said carburizing atmosphere is generated in situ by feeding said oven (40) with a gas-vapor mixture obtained by causing a carrier gas to bubble in a first liquid organic compound.

16. A method according to claim 15, characterized in that at least part of said protective atmosphere is generated in situ by feeding said oven (40) with a gas-vapor mixture obtained by causing a carrier gas to bubble in a second liquid organic compound.

17. A method according to claim 16, wherein said first liquid organic compound is constituted by ethylacetate or acetone and said carrier gas is constituted by nitrogen or by an exothermic gas.

18. A method according to claim 16, wherein said second liquid organic compound is constituted by methanol, and said carrier gas is constituted by nitrogen or air.

19. A method according to claim 17, wherein said exothermic gas is obtained by bubbling air as carrier gas in said second liquid organic compound to obtain a gaseous mixture that is submitted to combustion in a burner (80) and subsequent dehumidification by refrigeration.

20. A method according to claim 18, wherein said liquid organic compounds are heated independently from each other and kept at a temperature below the relevant boiling temperature.

21. A method according to claim 19, wherein the control of the quantities of said liquid organic compounds transferred under the form of vapor is automatically performed by acting on the relevant heating temperatures and/or on the flow rates of said carrier gases as a function of the carbon potential present in the oven (40).

22. A method according to claim 16, wherein said gas-vapor mixtures are obtained in saturator devices (1, 1*a*, 1*b*, 1*c*, 1*d*) working at atmospheric pressure.

23. A method comprising bubbling a carrier employing (1, 1*a*, 1*b*, 1*c*, 1*d*) for bubbling a carrier gas into a liquid compound, under controlled conditions of temperature and pressure, to generate and transfer a gas-vapor mixture having a controlled composition to an oven (40) for the formation in situ of at least part of the atmosphere for the thermal treatment of metal materials.

24. A method comprising employing a saturation device (1, 1*a*, 1*b*, 1*c*, 1*d*) contaning a liquid organic compound for forming a gas-vapor comburent mixture to be fed in an oven (40) for the formation of at least part of the atmosphere of thermal carburizing treatment of metal materials.

25. A method comprising employing a saturator device (1*c*) for bubbling a carrier gas into a liquid organic compound, under controlled conditions of temperature and pressure, to generate and transfer a gas-vapor comburent mixture having a controlled composition to a burner (80) and allow the formation of an exothermic gas to be fed as a carrier gas, after dehumidification, to another saturator device (1*d*).

26. A plant for the thermal treatment of metal materials in the presence of a treating atmosphere of a selected composition, the plant comprising:

an oven for containing said metal materials to be treated;

at least one saturator device containing a liquid compound and comprising means to regulate the temperature of the liquid compound, as well as means to cause a flow of carrier gas to bubble within the liquid compound and allow the transfer to said oven of the liquid compound in the form of vapor; and means for connecting the outlet duct of said at least one saturator device to the inlet of said oven in order to form at least part of said treating atmosphere by feeding said gas-vapor mixture to said oven.

27. The plant according to claim 26 comprising means for regulating the flow rate of said carrier gas.

28. The plant according to claim 27 comprising means for detecting the composition of said treating atmosphere within said oven and means connected to the detecting means for controlling the composition of the gas-vapor mixture generated by said saturator device according to the detected composition of the treating atmosphere within said oven.

29. A method for the thermal treatment of metal materials inside an oven by generating a treating atmosphere of a selected composition in said oven, the method comprising feeding said oven with a gas-vapor mixture generated by at least one saturator device, in which saturator device a carrier gas is caused to bubble within a liquid compound of controlled pressure and temperature conditions that allow transfer to said oven of the liquid compound in the form of vapor, so as to generate at least part of said treating atmosphere within the oven.

30. The method according to claim 29, wherein the composition of said gas-vapor mixture is controlled by varying the temperature of a liquid compound within the saturator device and/or by varying the flow rate of the carrier gas bubbling within said liquid compound.

31. The method according to claim 30 further comprising detecting the composition of said treating atmosphere within the oven and controlling the composition of said gas-vapor mixture according to the detected composition of the treating atmosphere within the oven.

* * * * *